US008174350B2

(12) United States Patent
Furuhata et al.

(10) Patent No.: US 8,174,350 B2
(45) Date of Patent: May 8, 2012

(54) THERMAL OVERLOAD RELAY

(75) Inventors: Yukinari Furuhata, Konosu (JP); Fumihiro Morishita, Konosu (JP); Takeo Kamosaki, Konosu (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 190 days.

(21) Appl. No.: 12/659,283

(22) Filed: Mar. 3, 2010

(65) Prior Publication Data

US 2010/0245019 A1 Sep. 30, 2010

(30) Foreign Application Priority Data

Mar. 27, 2009 (JP) ..... 2009-079395
May 29, 2009 (JP) ..... 2009-130687

(51) Int. Cl.
*H01H 71/16* (2006.01)
*H01H 61/04* (2006.01)
*H01H 75/08* (2006.01)

(52) U.S. Cl. ..... 337/52; 337/49; 337/85; 337/112; 337/333; 335/45

(58) Field of Classification Search ..... 337/52, 337/85, 112, 49, 333; 335/45
See application file for complete search history.

(56) References Cited

U.S. PATENT DOCUMENTS 3,800,260 A * 3/1974 Woodger ..... 337/49
4,635,020 A * 1/1987 Sako ..... 337/49
4,642,598 A * 2/1987 Ichikawa et al. ..... 337/82
4,652,847 A * 3/1987 Sako ..... 337/49
4,670,728 A * 6/1987 Akiike et al. ..... 337/49
4,808,961 A * 2/1989 Sako et al. ..... 337/49
4,814,737 A * 3/1989 Ebnet ..... 337/49
4,845,455 A * 7/1989 Sako et al. ..... 337/49
4,908,594 A * 3/1990 Akiike et al. ..... 337/49
5,046,227 A * 9/1991 Akiike et al. ..... 29/896.9
5,054,754 A 10/1991 Akiike et al.
5,767,762 A * 6/1998 Sako ..... 337/348
6,459,355 B1 10/2002 Furuhata et al.
2004/0085702 A1* 5/2004 Ohkubo ..... 361/161
2010/0245018 A1* 9/2010 Furuhata et al. ..... 337/37
2010/0245020 A1* 9/2010 Morishita et al. ..... 337/72
2010/0245021 A1* 9/2010 Furuhata et al. ..... 337/112
2010/0253467 A1* 10/2010 Kamosaki et al. ..... 337/85

* cited by examiner

*Primary Examiner* — Bradley Thomas
(74) *Attorney, Agent, or Firm* — Manabu Kanesaka

(57) ABSTRACT

A thermal overload relay has a case, a main bimetal bending upon detection of an overload current, a release lever rotatably supported by an adjusting link and rotating according to a shifter displaced in response to the bending of the main bimetals, and a contact reversing mechanism for change-over contacts responsive to a rotation of the release lever. The main bimetal, release lever and contact reversing mechanism are disposed in the case. The contact reversing mechanism has a movable plate, and a reversing spring stretched between the other side of the movable plate and a spring support. The other end of the movable plate and the spring support is positioned opposite a support point. The release lever has a release lever supporting part, a reversing spring pushing part, a cam contact part, and a displacement input part, in which the release lever supporting part is pivoted on the adjusting link.

6 Claims, 9 Drawing Sheets

THERMAL OVERLOAD RELAY

BACKGROUND OF THE INVENTION AND RELATED ART STATEMENT

The present invention relates to a thermal overload relay for change-over of a contact upon detection of an overcurrent.

Patent Document 1, for example, discloses a thermal overload relay operated by detecting an overcurrent running in the main circuit.

The thermal overload relay of Patent Document 1 is described referring to FIGS. 8 and 9. As shown in FIG. 8, the thermal overload relay comprises, an insulator case 1 made of a resin mould which houses main bimetals 2 inserted in three phase electric circuit and wound with heaters 2*a*, a shifter 3 linked to free ends of the main bimetals 2 and movably supported in the insulator case 1, a reversing mechanism 4 disposed in the insulator case 1 linkable to one end of the shifter 3, and a switching mechanism 5 to changeover contacts by operation of the reversing mechanism 4.

The reversing mechanism 4 comprises, as also shown in FIG. 9, a temperature compensation bimetal 7 to link to the one end of the shifter 3, a release lever 8 to which the other end of the temperature compensation bimetal 7 is fixed, and an adjusting link 12 connecting to the release lever 8 through a swinging pin 9 projecting at the lower end of the adjusting link and abutting on the circumferential surface of an eccentric cam 11*a*. This cam 11*a* is associated with an adjusting dial 11 disposed rotatably in the insulator case 1 at the upper end of the adjusting link 12. A rotation angle of the release lever 8 is set by varying an abutting position of the adjusting link 12 with the circumferential surface of the eccentric cam 11*a* of the adjusting dial 11 through adjustment of the adjusting dial 11, thereby slightly rotating the adjusting link 12 around a support shaft 13.

The switching mechanism 5 comprises: a reversing spring 14 fixed at its lower end to the release lever 8 and extending upwards, a slider 17 linked to the tip of the reversing spring 14 and carrying a normally opened side movable contact piece 15*b* and a normally closed side movable contact piece 16*a*, and a reset bar 18 to manually move the slider 17 to the normal position. The switching mechanism 5 further comprises the above mentioned normally opened side movable contact piece 15*b* and the normally closed side movable contact piece 16*a*, and a normally opened side fixed contact piece 15*a* and a normally closed side fixed contact piece 16*b*. Both the fixed contact pieces are disposed opposing the movable contact pieces. The reversing spring 14 is a member having a punched window 14*a* formed by punching a thin spring material and a curved surface with a disc spring shape around the punched window 14*a*. The reversing spring 14 is curved with a convex towards right hand side in a normal state shown in FIG. 8.

When the bimetal 2 bends with the heat generated by the heater 2*a* due to an overcurrent in the above-described structure, the shifter 3 shifts to the direction indicated by the arrow P in FIG. 8 caused by displacement of the free end of the main bimetal 2. The shift of the shifter 3 pushes a free end of the temperature compensation bimetal 7 and rotates the release lever 8 counterclockwise around the swinging pin 9.

With the progression of the counterclockwise rotation of the release lever 8, the reversing spring 14 deforms, bending convexly towards the left hand side (as seen in FIG. 8). The deformation of the reversing spring 14 moves the slider 17 linked to the tip of the reversing spring 14 so as to turn the normally opened side movable contact piece 15*b* and the normally opened side fixed contact piece 15*a* into a closed state and to turn the normally closed side movable contact piece 16*a* and the normally closed side fixed contact piece 16*b* into an opened state. Based on the indication of the closed state of the normally opened side movable contact piece 15*b* and the normally opened side fixed contact piece 15*a*, and the information of the opened state of the normally closed side movable contact piece 16*a* and the normally closed side fixed contact piece 16*b* conducted by the reversing action of the reversing mechanism 4, an electromagnetic contactor (not shown in the figures), for example, connected in the main circuit is opened to interrupt the overcurrent.

[Patent Document 1]

Japanese Examined Patent Publication No. H7-001665

Meanwhile, in the conventional thermal overload relay described above, if the support shaft 13 of the switching mechanism 4 projecting out of the inner wall of the insulator case 1 is worn by prolonged use, a position of the pin 9, which is projecting out of the bottom of the adjusting link 12 and rotatably supporting the release lever 8, changes. The change of the position of the pin 9 induces change of position of the temperature compensation bimetal 7 fixed on the release lever 8.

Thus, the position change of the temperature compensation bimetal 7 due to wear of the support shaft 13 of the reversing mechanism 4 may cause a variation of a reversing operation point of the reversing mechanism 4 in the event of overload current. Therefore, the operation performance may be unstable in the thermal overload relay.

In view of the above-described unsolved problems in the conventional technology example, it is an object of the present invention to provide a thermal overload relay that suppresses variation of a reversing operation point of the contact reversing mechanism and performs stable operation of a thermal overload relay.

Further objects and advantages of the invention will be apparent from the following description of the invention.

SUMMARY OF THE INVENTION

In order to accomplish the above object, a thermal overload relay according to the present invention comprises: a case; a main bimetal which bends upon detection of an overload current; a release lever rotatably supported by an adjusting link and rotating according to displacement of a shifter that displaces following the bending of the main bimetals; and a contact reversing mechanism for change-over contacts by reversing action caused by rotation of the release lever. All three of these latter members are disposed in the case.

The contact reversing mechanism itself comprises a movable plate disposed at a support point at one end thereof so as to be swingable at the other end, and a reversing spring stretched between the other side of the movable plate and a spring support. The other end of the movable plate and the spring support are positioned opposite to each other with respect to the support point. The release lever is provided as a single structure and comprises a release lever supporting part, a reversing spring pushing part, a cam contact part, and a displacement input part, in which the release lever supporting part is supported rotatably on the adjusting link. The reversing spring pushing part is formed at one end of the release lever supporting part and pushes the reversing spring towards a direction to reversing the movable plate, the cam contact part being formed at the other end of the release lever supporting part and being pushed towards an eccentric cam of an adjusting dial provided on the case to keep in contact with the eccentric cam, and the displacement input part coupling to the displaced shifter and making rotation of the reversing spring pushing part and the cam contact part around the release lever supporting part.

According to the above-stated invention, the release lever is provided, assembled together in one body, with a reversing spring pushing part to push a reversing spring in the direction of reversing a movable plate, a cam contact part that is pushed by an eccentric cam of an adjusting dial provided on the case and contacts the eccentric cam, and a displacement input part coupled to the displaced shifter. In the tripped state, the release lever is held at three points: an input point (a displacement input part) for inputting a displacement of the shifter, a support point (a cam contact part) in contact with the eccentric cam of the adjusting dial, and an output point (a reversing spring pushing part) for outputting a pushing force on the reversing spring. As a result, the adjusting link receives very little load and avoids any undesired external affection including wear and creep, thereby maintaining a constant reversing operation point of the contact reversing mechanism. Therefore, a thermal overload relay achieves stable operation performance.

In a thermal overload relay of the invention, the adjusting link comprises, in one end side, a bearing part rotatably supported on a support shaft provided integrally on the case, and in the other end side, a link support rotatably supporting only the release lever supporting part of the release lever.

According to the above-stated invention, the adjusting link only supports the release lever and receives no load from the shifter and the reversing spring in the tripped state, eliminating consideration on material deformation due to creep, thus allowing manufacture using an inexpensive material.

In the thermal overload relay according to the present invention, the contact reversing mechanism is provided with a reversing mechanism support that has a coupling groove that supports the one end of the movable plate at the support point, and movable plate holding arms on which the other end side of the movable plate abuts and which supports the movable plate in a tilted condition with a constant tilting quantity and the reversing spring is a tension coil spring having a coupling parts with a configuration of a hook formed at both ends of the spring, one of the coupling parts coupling to the other end side of the movable plate and the other coupling part coupling to the spring support provided on the reversing mechanism support, and the reversing spring gives a tension force to and holds the movable plate that is abutting on and supported by the movable plate holding arms in a tilted condition.

According to the above-stated invention, the reversing spring holds the movable plate always generating a constant tension force because the other side of the movable plate is abutting on the movable plate holding arms of the reversing mechanism support ensuring a constant tilting amount. The pushing force at the reversing spring pushing part of the release lever to start the reversing action of the movable plate is also constant for the reversing spring that is holding the movable plate with a constant tension force. Therefore, the operation point of the release lever is constant, further stabilizing the operation performance of a thermal overload relay. Employment of an inexpensive tension coil spring reduces manufacturing costs of a thermal overload relay.

In a thermal overload relay of the invention, the movable plate and the tension coil spring are formed together in a single unit and assembled in the reversing mechanism support. The reversing mechanism support is also provided with a movable side terminal of a normally opened contact or a normally closed contact.

According to the above-stated inventions, reduction of costs is further promoted in manufacturing a thermal overload relay.

In a thermal overload relay of the invention, the displacement input part is a temperature compensation bimetal fixed on the release lever.

According to this invention, employment of a temperature compensation bimetal for a displacement input member to input the displacement of shifter provides a thermal overload relay that ensures sufficient accuracy of compensation for environmental temperature variation.

In a thermal overload relay according to the present invention, as noted above, the release lever in a tripped state is held at three points: an input point (a displacement input part) for inputting a displacement of the shifter, a support point (a cam contact part) in contact with the eccentric cam of the adjusting dial, and an output point (a reversing spring pushing part) for outputting a pushing force on the reversing spring. As a result, the adjusting link receives very little load and avoids any undesired external affection including wear and creep, thereby keeping a constant reversing operation point of the contact reversing mechanism. Therefore, a thermal overload relay achieves stable operation performance.

BRIEF DESCRIPTION OF THE DRAWINGS

FIG. 5(*b*) is a drawing showing the contact reversing mechanism and a normally opened contact (a-contact) that are in a tripped state;

FIG. 6(*b*) is a drawing showing the contact reversing mechanism and a normally closed contact (b-contact) that are in a tripped state;

DETAILED DESCRIPTION OF PREFERRED EMBODIMENTS

Figure 8:
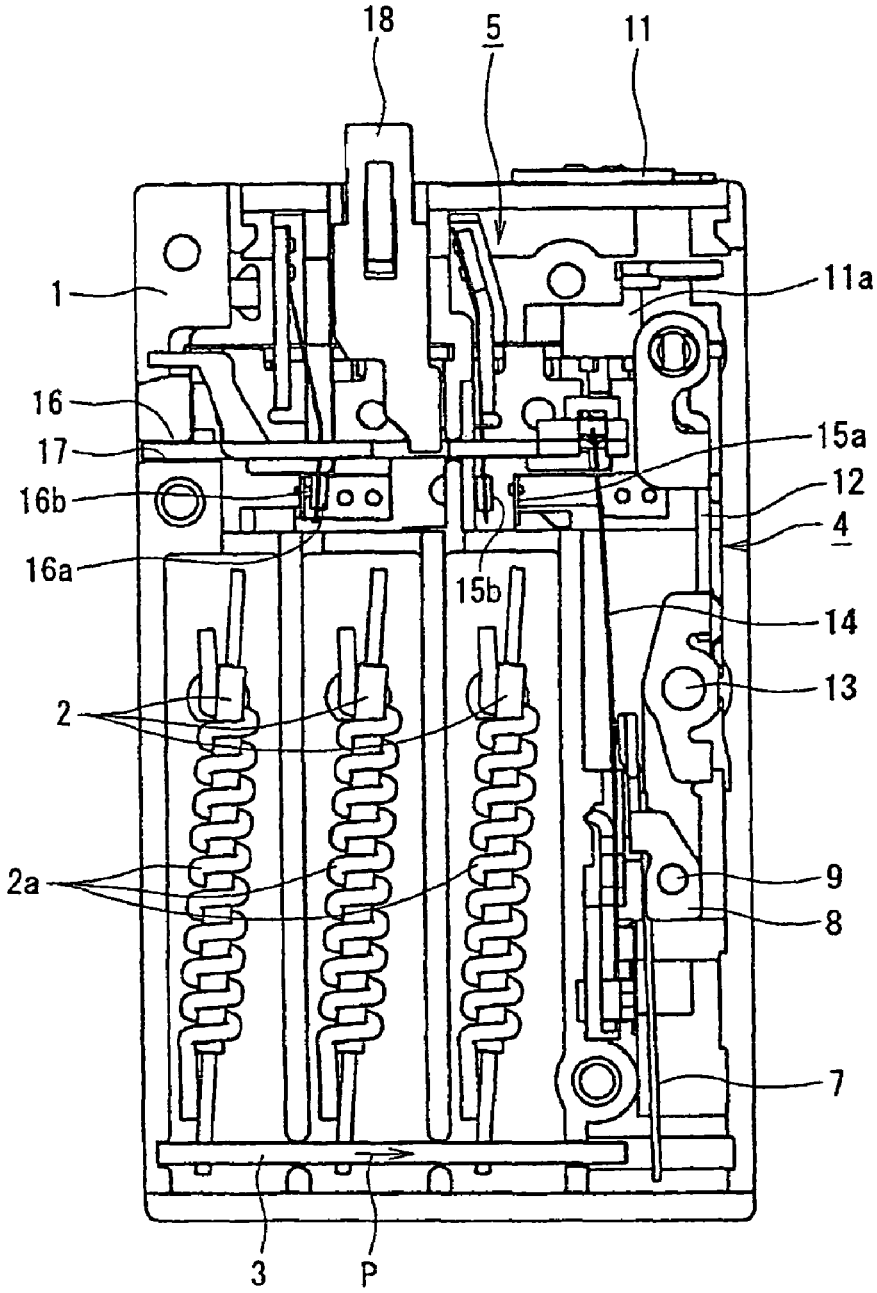
Fig. 8 PRIOR ART
FIG. 8 is a drawing showing essential parts of a prior art thermal overload relay in a normal state.
Figure 9:
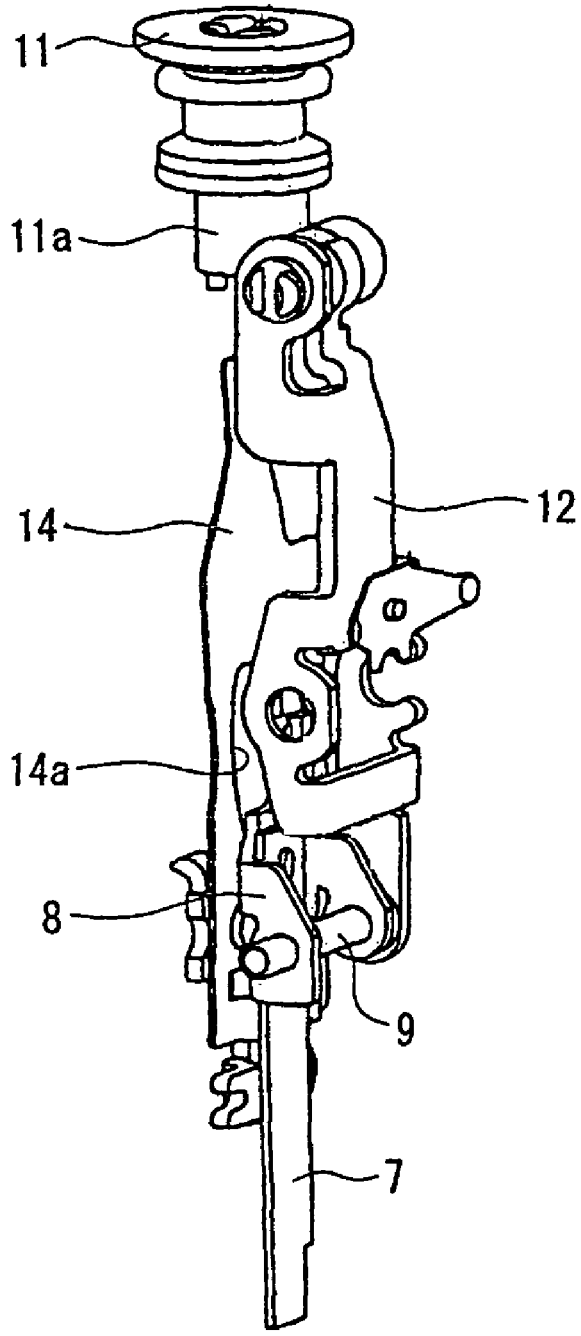
Fig. 9 PRIOR ART
FIG. 9 is a perspective view of an adjusting mechanism of the prior art thermal overload relay.

The following describes some preferred examples of embodiments according to the invention in detail with reference to the accompanying drawings. The parts of the embodiment of the invention similar to the parts in FIG. 8 and FIG. 9 are given the same symbols and their description is omitted.

Figure 1:
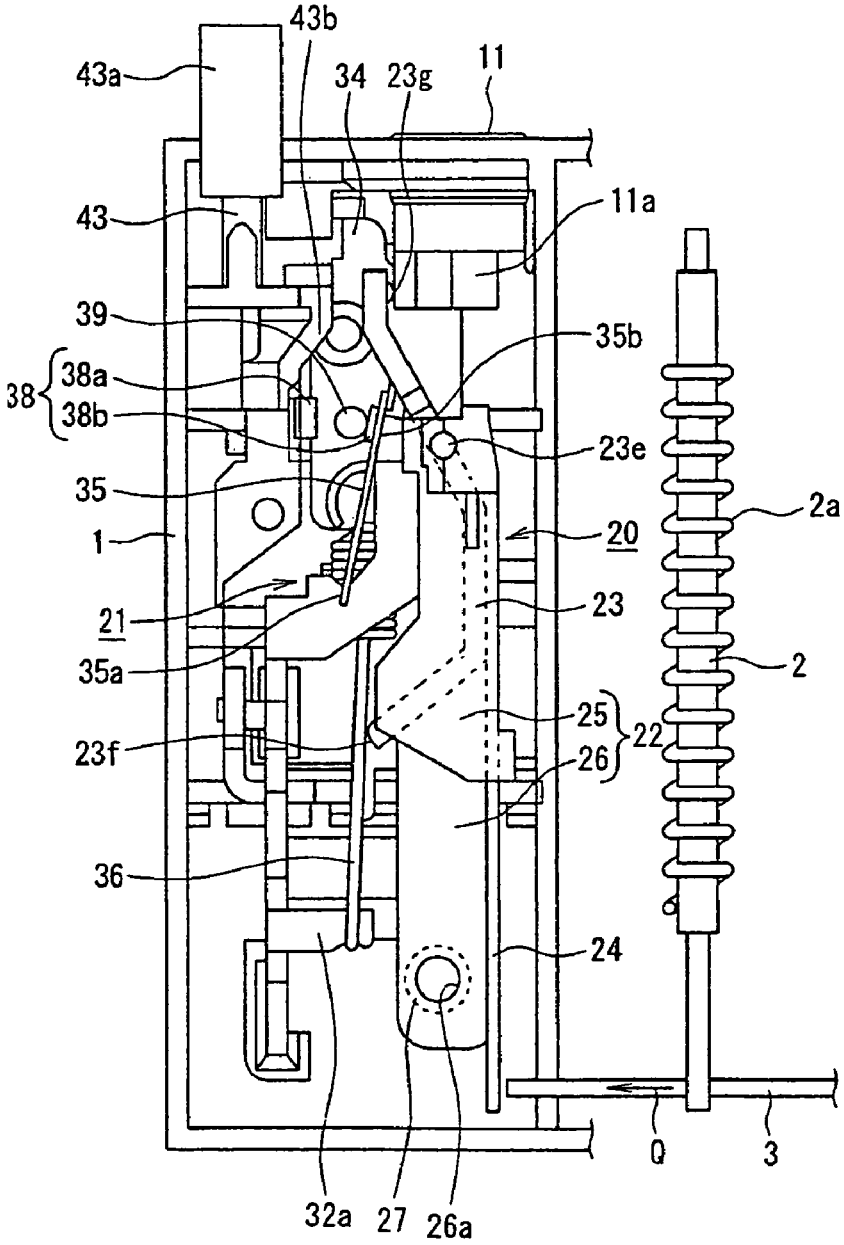
FIG. 1 is a drawing showing basic parts in a normal state of a thermal overload relay according to the present invention.
Figure 2:
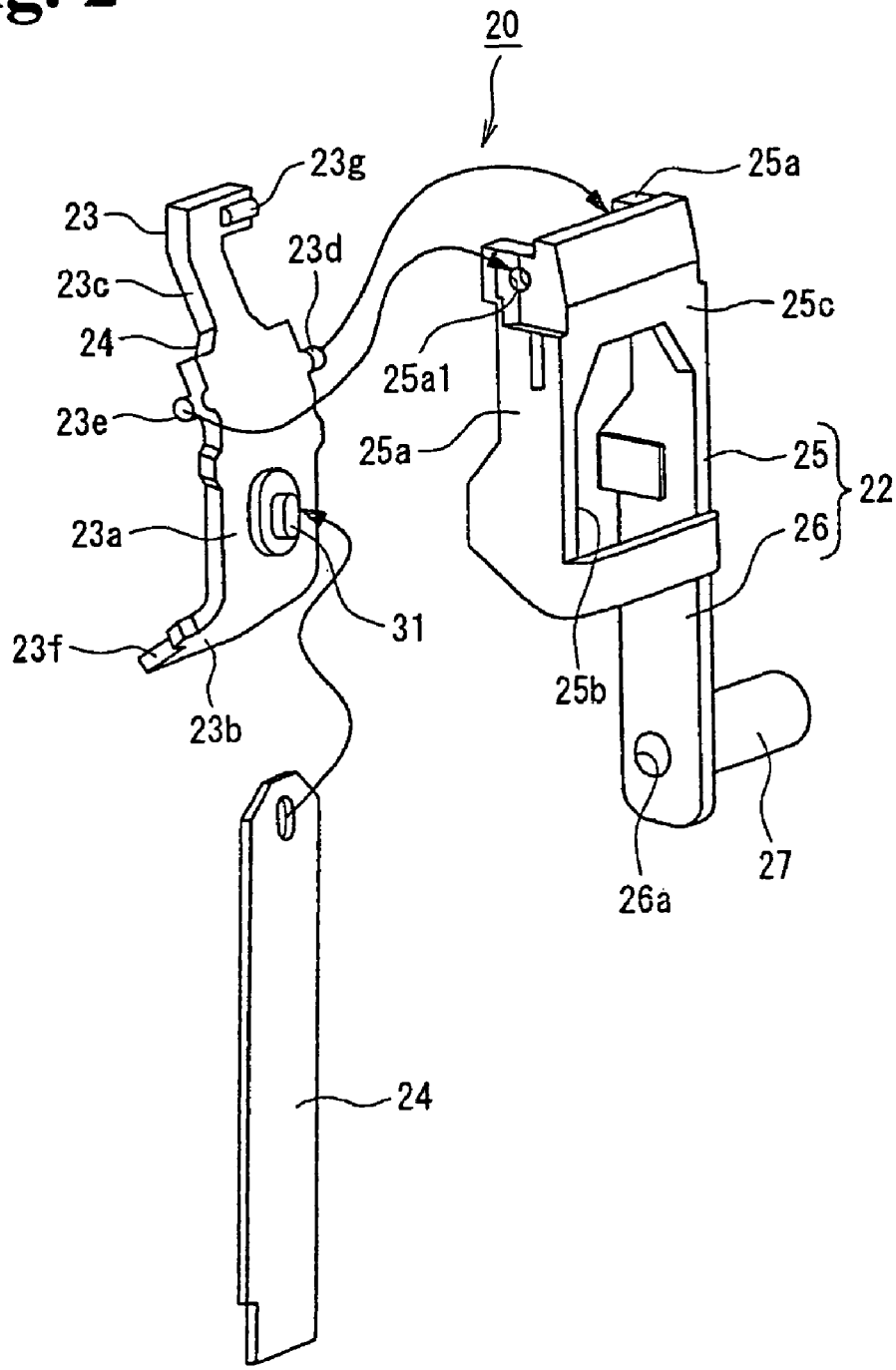
FIG. 2 is an exploded perspective view of an adjusting mechanism of a thermal overload relay according to the present invention.
Figure 3:
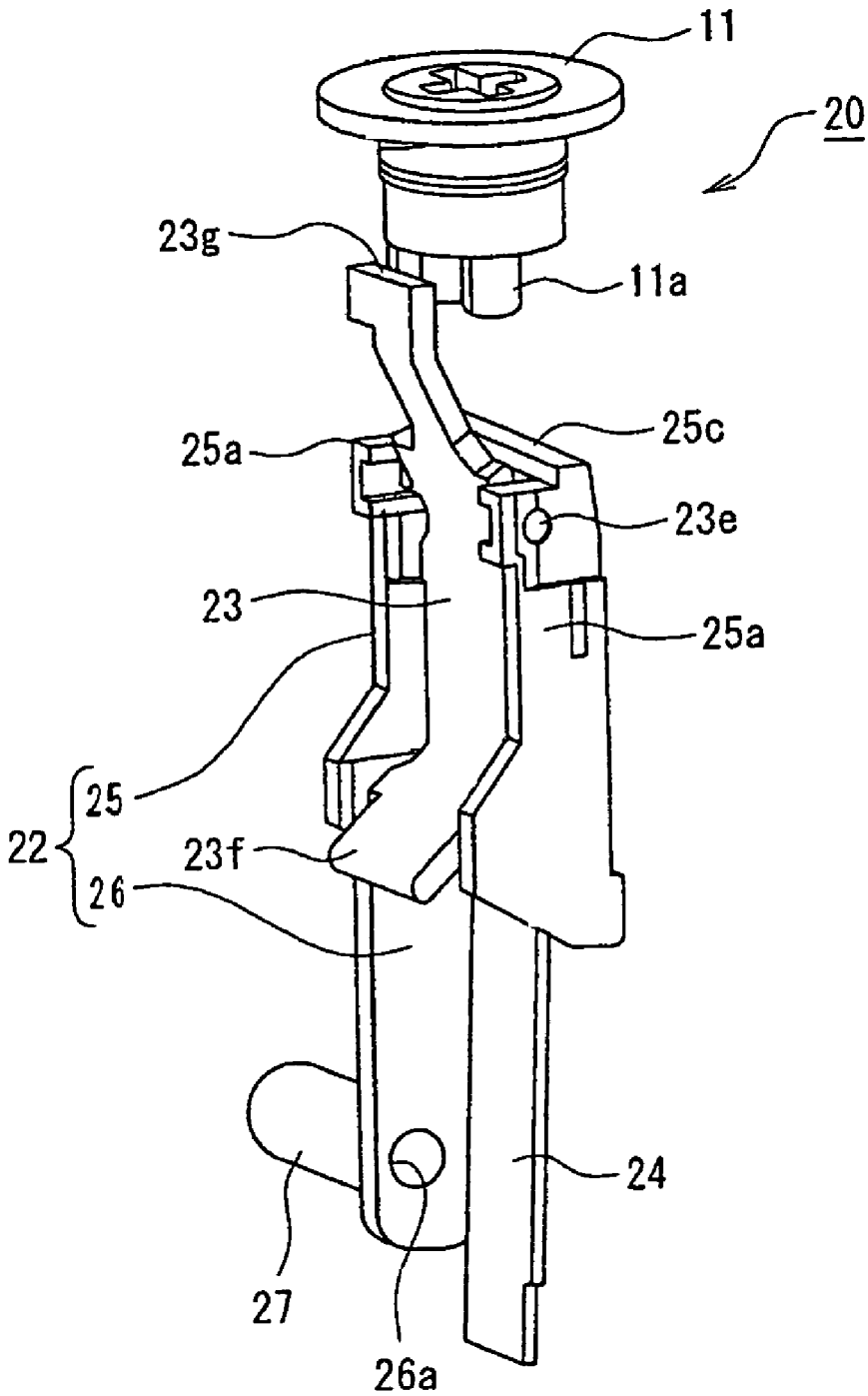
FIG. 3 is a perspective view of the adjusting mechanism in contact with an adjusting dial of a thermal overload relay according to the present invention.
Figure 4:
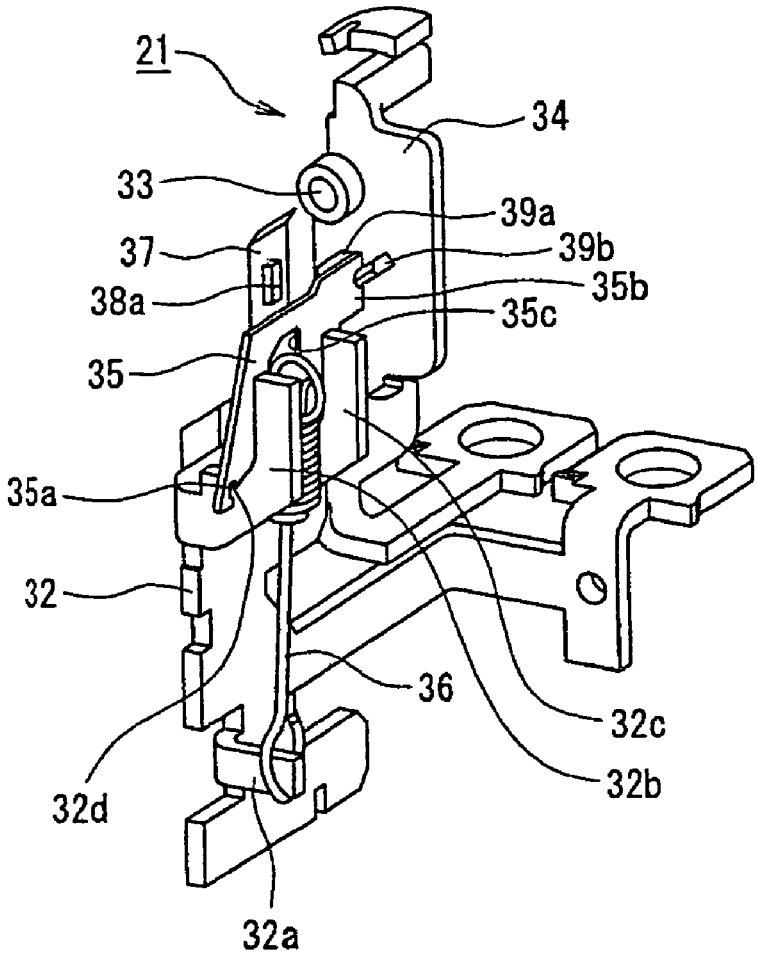
FIG. 4 is a perspective view of a contact reversing mechanism of a thermal overload relay according to the present invention.
Figure 5A:
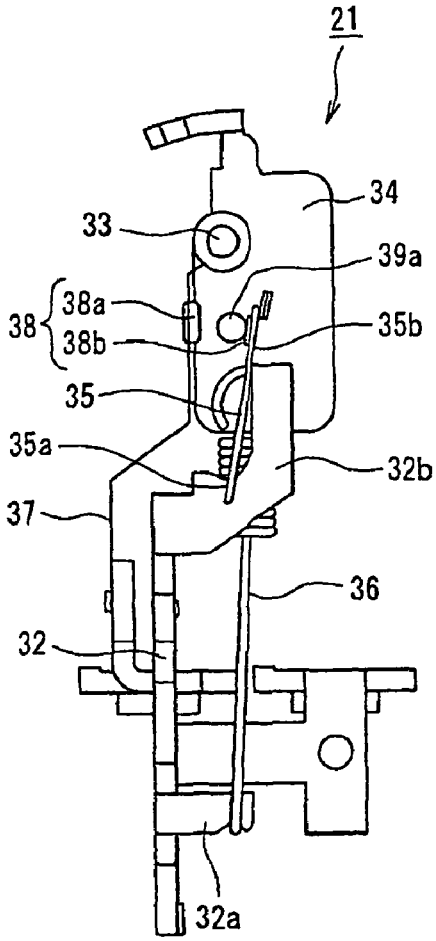
FIG. 5(*a*) is a drawing showing the contact reversing mechanism and a normally opened contact (a-contact) that are in the normal state or a reset state.
Figure 5B:
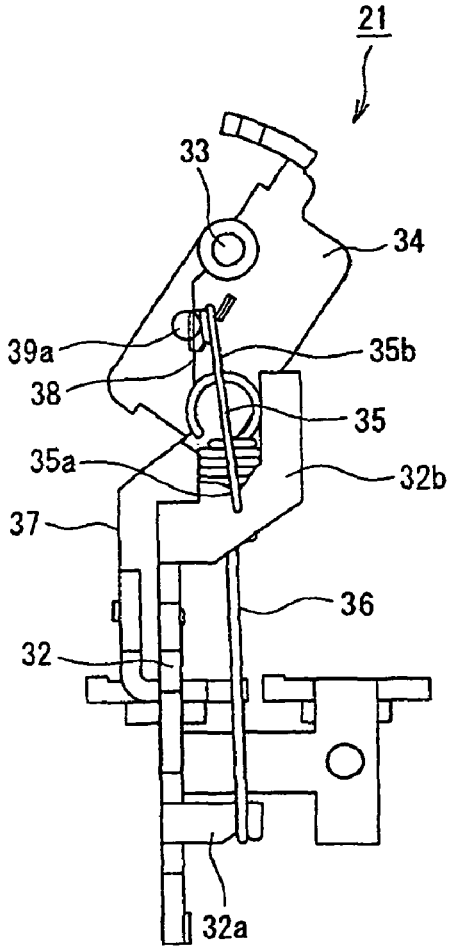
Figure 6A:
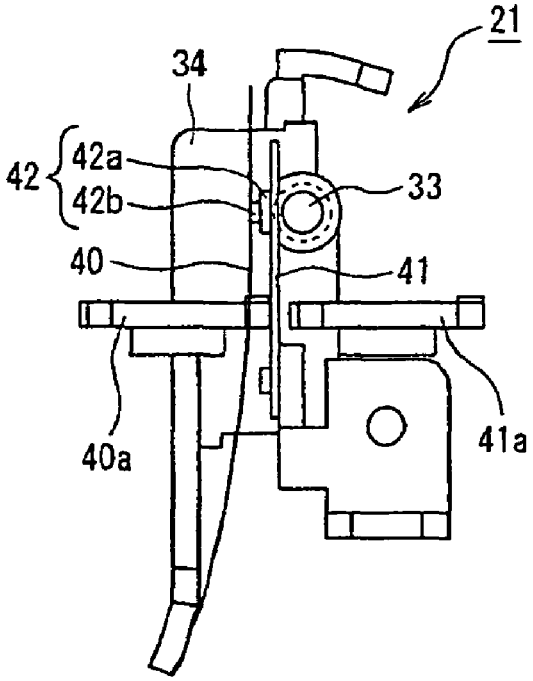
FIG. 6(*a*) is a drawing showing the contact reversing mechanism and a normally closed contact (b-contact) that are in a normal state or a reset state.
Figure 6B:
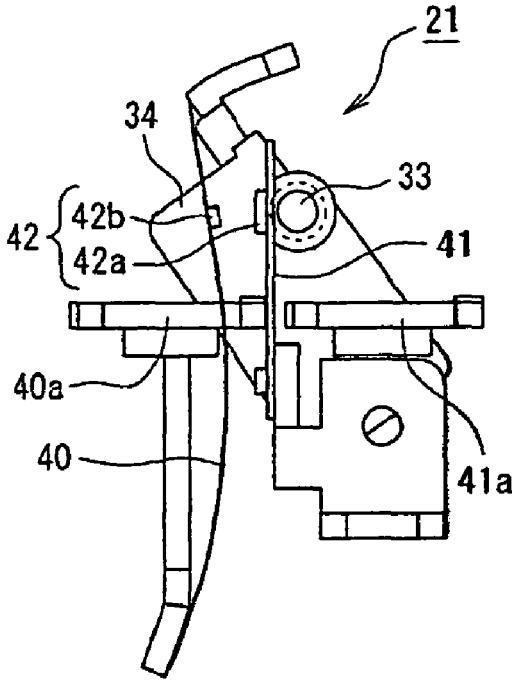
Figure 7:
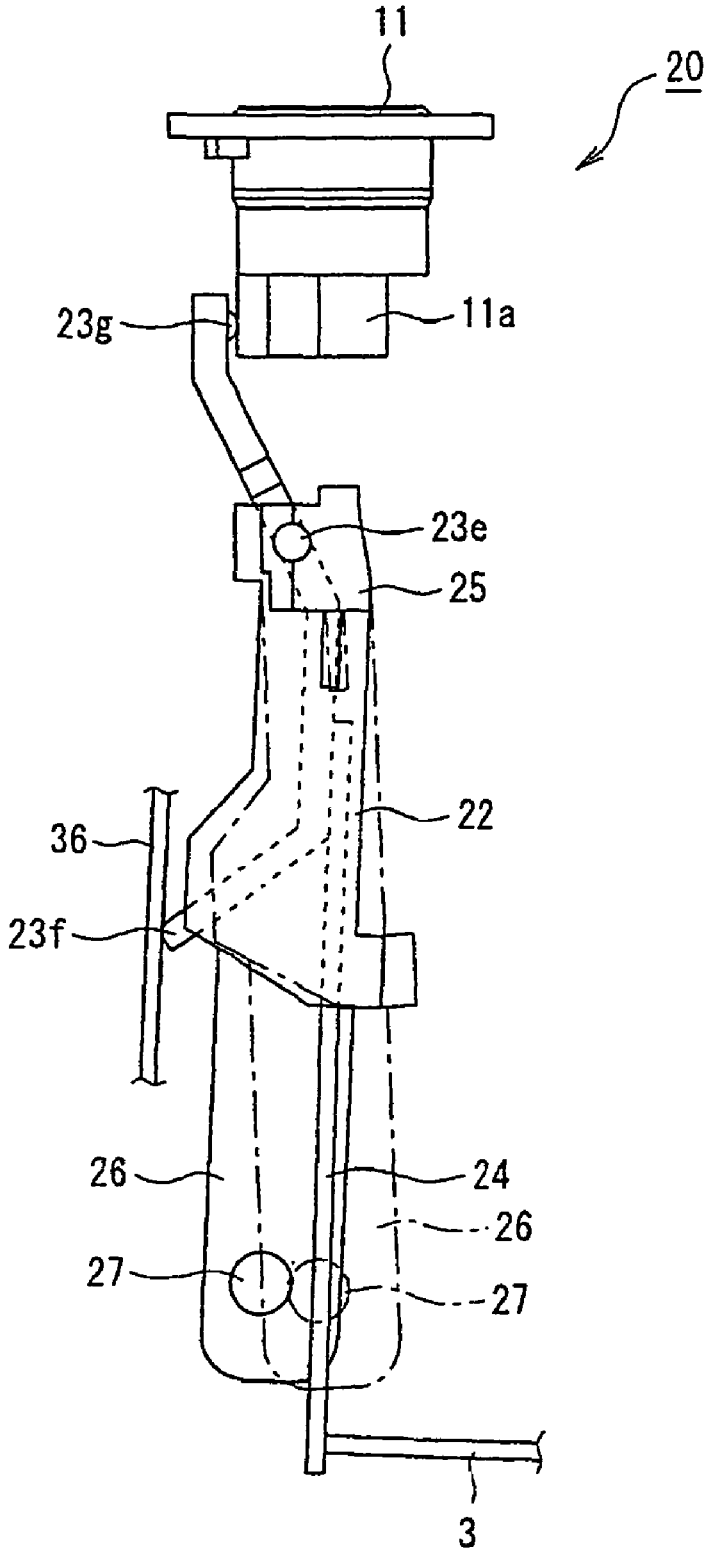
FIG. 7 is a drawing showing function of the adjusting mechanism of a thermal overload relay according to the present invention.

FIGS. 1 through 7 show an embodiment of a thermal overload relay according to the invention. FIG. 1 is a drawing showing essential parts in a normal state; FIG. 2 is an exploded perspective view of an adjusting mechanism; FIG. 3 is a perspective view of the adjusting mechanism in contact with an adjusting dial; FIG. 4 is a perspective view of a contact reversing mechanism; FIG. 5(*a*) is a drawing showing the contact reversing mechanism and a normally opened contact (a-contact) that are in the normal state or a reset state; FIG. 5(*b*) is a drawing showing the contact reversing mechanism and a normally opened contact (a-contact) that are in a tripped state; FIG. 6(*a*) is a drawing showing the contact reversing mechanism and a normally closed contact (b-contact) that are in a normal state or a reset state; FIG. 6(*b*) is a drawing showing the contact reversing mechanism and a normally closed contact (b-contact) that are in a tripped state; FIG. 7 is a drawing showing function of the adjusting mechanism.

The thermal overload relay of this embodiment as shown in FIG. 1 comprises, in the insulator case 1: an adjusting mechanism 20 that works according to displacement of a shifter 3 linked to a free end of a main bimetal 2, a contact reversing mechanism 21 that changes-over contacts by an action of the adjusting mechanism 20, and a reset bar 43 for resetting the contact reversing mechanism 21.

The adjusting mechanism 20 comprises an adjusting link 22, a release lever 23 rotatably supported by the adjusting link 22, and a temperature compensation bimetal 24 fixed to the release lever 23 and linked to the shifter 3.

The adjusting link 22 is composed, as shown in FIG. 2, of a link support 25 supporting the release lever 23 and a leg part 26 extending downwards from one side of the link support 25.

The link support 25, including a pair of bearing holes 25*a*1 formed in the upper portion thereof, has a pair of opposing plates 25*a* opposing each other and a connection plate 25*c* connecting the pair of opposing plates 25*a* and forming an opening 25*b*. The leg part 26 extends downwards from one of the pair of opposing plates 25*a* and includes a bearing hole 26*a* in the lower portion thereof.

A support shaft 27 is provided protruding from the inner wall at the lower part of the insulator case 1 into inside of the insulator case 1 as shown in FIG. 1. A tip of the support shaft 27 having a reduced diameter is inserted into the bearing hole 26*a* of the leg part 26 and the whole adjusting link 22 is supported rotatably around the support shaft 27 in the insulator case 1.

The release lever 23 has, as shown in FIG. 2, a base plate 23*a*, a pair of bent plates 23*b*, 23*c* bent from the both ends of the base plate 23*a* towards the same direction with an approximately equal angle. At the side of the bent plate 23*c*, a pair of rotating shafts (the release lever supporting part) 23*d*, 23*e* are formed to be inserted into the pair of bearing holes 25*a*1 of the adjusting link 22. A reversing spring-pushing part 23*f* is formed at the lower end of the bent plate 23*b*, and a cam contacting part 23*g* is formed at the upper end of the bent plate 23*c*, the reversing spring-pushing part 23*f* and the cam contacting part 23*g* positioning at the opposite sides with respect to the pair of rotating shafts 23*d*, 23*e*. A caulking part 31 is formed for fixing an end of the temperature compensation bimetal 24 by caulking on the rear surface of the base plate 23*a*, the rear surface being in the side opposite to the direction of bending of the bent plates 23*b*, and 23*c*.

The contact reversing mechanism 21 comprises, as shown in FIG. 4 and FIG. 5(*a*), an a-contact movable side terminal 32 disposed in the insulator case 1, an interlock plate 34 disposed in the vicinity of the a-contact movable side terminal 32 and rotatably supported on a support shaft 33 formed on the inner wall of the insulator case 1, a movable plate 35 disposed swingably (which means capability of freely conducting a reversing operation and a returning operation) on the upper portion of the a-contact movable side terminal 32, a pair of movable plate holding arms 32*b*, 32*c* supporting the movable plate 35 abutted by the upper portion 35*b* of the movable plate 35 in a tilted condition, and a reversing spring 36 that is a tension coil spring stretching between a coupling hole 35*c* formed in the side of the upper portion 35*b* of the movable plate 35 and a spring support 32*a* formed in the lower part of the a-contact movable side terminal 32. The reversing spring 36 is a tension coil spring and gives a tension force to support the movable plate 35 that is abutting on the pair of movable plate holding arms 32*b*, 32*c* in a tilted condition.

The interlock plate 34 has, as shown in FIG. 5(*a*), a first linking pin 39*a* capable of linking to the movable plate 35, the first linking pin 39*a* and a second linking pin 39*b* making the interlock plate 34 to rotate around the support shaft 33 in the reversing operation and the returning operation of the movable plate 35.

The pair of movable plate holding arms 32*b*, 32*c*, as shown in FIG. 4, extends in parallel with each other from the upper portion of the a-contact movable side terminal 32 in the direction along the surface of the interlock plate 34 and has a coupling groove 32*d* in the lower end side of the movable plate holding arms 32*b*, 32*c*. The movable plate 35 in a normal state or a reset state, as shown in FIG. 5(*a*), couples to the coupling groove 32*d* at the lower portion 35*a* of the movable plate 35, and is in contact with the pair of movable plate holding arms 32*b*, 32*c* at the upper portion 35*b* of the movable plate 35 to be held in a tilted state. The movable plate 35 in a tripped state as shown in FIG. 5(*b*) is in a condition wherein the upper part 35*b* has been swung around the lower part 35*a* coupled to the coupling groove 32*d* in the direction of the upper part 35*b* departing from the upper part of the pair of movable plate holding arms 32*b*, 32*c*.

An a-contact fixed side terminal 37 is provided on the a-contact movable side terminal 32 in the configuration with the free end of the a-contact fixed side terminal 37 extending upwards, as shown in FIG. 5(*a*). A fixed contact piece 38*a* of the a-contact 38 is fixed on the free end side of the a-contact fixed side terminal 37. A movable contact piece 38*b*, which is to be made in contact with the fixed contact piece 38*a*, of the a-contact 38 is fixed on the upper portion 35*b* of the movable plate 35.

As shown in FIG. 6(*a*), in the reverse side of the a-contact. 38 with respect to the intervening interlock plate 34, a leaf spring 40 of the normally closed contact (b-contact) side is disposed in the condition of the free end thereof extending upwards, and a contact support plate 41 is disposed facing this b-contact side leaf spring 40. The b-contact side leaf spring 40 is disposed with the free end thereof linkable to a part of the interlock plate 34, and rotates in the same direction as the rotation of the interlock plate 34. The movable contact piece 42*b* of the b-contact 42 is fixed in the free end side of the b-contact side leaf spring 40, and the fixed contact piece 42*a* of the b-contact 42 to be connected to the movable contact piece 42*b* is fixed on the contact supporting plate 41. The b-contact side leaf spring 40 is provided with a b-contact side terminal 40*a* formed in a monolithic configuration, and the contact support plate 41 is provided with a b-contact fixed side terminal 41*a* formed in a monolithic configuration.

The reset bar 43 comprises, as shown in FIG. 1, a reset button 43*a* that is pushed-in manually into the insulator case 1 and a slope 43*b* for returning the movable plate 35 that is in contact with the a-contact side leaf spring 37 and in a tripped state as shown in FIG. 5(*b*) to the initial position (normal state).

Now, operation of the thermal overload relay of the embodiment will be described.

When the main bimetal 2 is bent with the heat generated in the heater 2*a* by an overcurrent, displacement of the free end of the main bimetal 2 displaces the shifter 3 in the direction of arrow Q indicated in FIG. 1. When the free end of the temperature compensation bimetal 24 is pushed by the displaced shifter 3, the release lever 23 joined to the temperature compensation bimetal 24 rotates clockwise around the rotating shafts 23*d*, 23*e* supported by the adjusting link 22 and the reversing spring pushing part 23*f* of the release lever 23 pushes the reversing spring 36.

At the moment the pushing force of the reversing spring pushing part 23*f* exceeds the spring force of the reversing spring 36 (the force is equal to a component force in the direction against the pushing force), the movable plate 35 starts to perform a reversing action around the lower part 35*a*. Here, the upper portion 35*b* of the movable plate 35 is abutting on the pair of movable plate holding arms 32*b*, 32*c*, ensuring a constant amount of tilting quantity, and a constant amount of tension force is developed in the reversing spring 36 to hold the movable plate 35. On this reversing spring 36 with the constant amount of tension force developed therein, the pushing force acts from the reversing spring pushing part 23*f*. In progression of the reversing action of the movable plate 35 conducted by the pushing force from the reversing spring pushing part 23*f*, the tension force in the reversing spring 36 gradually increases. At the moment the line connecting the lower portion 35*a* and the upper portion 35*b* of the movable plate 35 and the axis line of the reversing spring 36 becomes in coincidence with each other, the tension force of the reversing spring 36 becomes the maximum. When the reversing action of the movable plate 35 progresses and the upper portion 35*b* of the movable plate 35 moves towards the direction to depart from the pair of movable plate holding arms 32*b*, 32*c*, the tension force of the reversing spring 36 abruptly decreases.

Accompanying the reversing action of the movable plate 35, the interlock plate 34, receiving the reversing action of the movable plate 35 transmitted through the first linking pin 39*a*, rotates around the support shaft 33 (see FIG. 5(*b*) and FIG. 6(*b*)).

As a result, the fixed contact piece 38*a* and the movable contact piece 38*b* of the a-contact 38 in the opened state shown in FIG. 5(*a*) are connected together, and the fixed contact piece 42*a* and the movable contact piece 42*b* of the b-contact 42 in the closed state as shown in FIG. 6(*a*) are separated away. Based on the information of the a-contact 38 and the b-contact 42, the electromagnetic contactor (not illustrated) is opened to interrupt the overcurrent in the main circuit.

Then, in the condition of the main bimetal 2 returned to the original configuration from the bent state after interruption of the main circuit current, the reset button 43*a*is pushed-in. With this manual reset operation of the reset bar 43, the slope 43*b* of the reset bar 43 exerts a resetting force through the a-contact side leaf spring 37 on the movable plate 35 in the tripped state shown in FIG. 5(*b*), thereby returning the movable plate 35 to the position of the initial state and at the same time, returning the interlock plate 34 to the position of the initial state (normal state) through the second linking pin 139*b*. Thus, the thermal overload relay is reset.

Now, effects of the thermal overload relay of the embodiment will be described.

The release lever 23 in this embodiment comprises a cam contact part 23*g* and a reversing spring pushing part 23*f* formed therewith. The release lever 23 has an end of a temperature bimetal 24 fixed thereto. In the tripped state as shown in FIG. 7, the release lever 23 is supported at three points: an input point (the temperature compensation bimetal 24) for inputting the displacement of the shifter 3, a support point (the cam contact part 23*g*) in contact with the peripheral surface of the eccentric cam 11*a* of the adjusting dial 11, and an output point (a reversing spring pushing part 23*f*) for outputting a pushing force on the reversing spring 36.

Thus, the adjusting mechanism 20 of this embodiment is held by three points of an input point, a support point, and an output point. As a result, the adjusting link 22 receives very little load and avoids any undesired external affection including wear and creep, thereby keeping a constant reversing operation point of the contact reversing mechanism 21. Therefore, a thermal overload relay achieves stable operation performance.

The adjusting link 22 in this embodiment is rotatably supported by the support shaft 27 projecting out of the inner wall at a lower place in the insulator case 1 at the leg part 26 of the adjusting link 22. Even if the support shaft 27 has been worn due to aging or position of the support shaft 27 has been shifted due to fabrication error, changing the position of the leg part 26 to the position of the dotted line depicted in FIG. 7, because of the adjusting link 22 that is a member only supporting the release lever 23, the aging or positional error in the support shaft 27 does not adversely affect the operation performance of the thermal overload relay.

The reversing spring 36 holding the movable plate 35 always holds the movable plate 35 with a constant tension force because the upper portion 35*b* of the movable plate 35 is abutting on the pair of movable plate holding arms 32*b*, 32*c* of the a-contact movable side terminal 32 ensuring a constant tilting quantity. For the reversing spring 36 holding the movable plate 35 with a constant tension force, the pushing force of the reversing spring pushing part 23*f* of the release lever 23 is also constant for starting a reversing operation of the movable plate 35. Accordingly, the operation point of the release lever 23 is constant, providing a thermal overload relay performing stable operation.

The adjusting link 22 only supporting the release lever 23 receives no load from the shifter 3 or the reversing spring 36 in the tripped state, eliminating consideration on material deformation due to creep. Therefore, an inexpensive material without consideration of strength can be used for manufacturing a thermal overload relay.

An inexpensive tension coil spring is employed for the reversing spring 36, which reduces manufacturing cost of the thermal overload relay The movable plate 35 and the reversing spring 36 are provide in a joined single unit in the a-contact movable side terminal 32 composing the contact reversing mechanism 21. Therefore, reduction of manufacturing costs of the thermal overload relay is promoted.

Employment of a temperature compensation bimetal 24 for a displacement input member to input the displacement of shifter 3 provides a thermal overload relay that ensures sufficient accuracy of compensation for environmental temperature variation.

The disclosures of Japanese Patent Applications No. 2009-079395 filed on Mar. 27, 2009 and No. 2009-130687 filed on May 29, 2009 are incorporated herein as references.

What is claimed is:

1. A thermal overload relay comprising:

a case;

a main bimetal which bends upon detection of an overload current;

a release lever rotatably supported by an adjusting link and rotating according to displacement of a shifter displaced in response to the bending of the main bimetal; and a contact reversing mechanism for changing-over contacts responsive to a rotation of the release lever;

the main bimetal, the release lever and the contact reversing mechanism being disposed in the case, and wherein the contact reversing mechanism comprises a movable plate supported at a support point at one end thereof and swingably at the other end, and a reversing spring stretched between the other end side of the movable plate and a spring support, the other end of the movable plate and the spring support being positioned opposite each other with respect to the support point; and the release lever is provided in a single structure and comprises a release lever supporting part, a reversing spring pushing part, a cam contact part, and a displacement input part, in which the release lever supporting part is supported rotatably on the adjusting link, the reversing spring pushing part is formed at one end of the release lever supporting part and pushes the reversing spring towards a direction to reversing the movable plate, the cam contact part is formed at the other end of the release lever supporting part and is pushed towards an eccentric cam of an adjusting dial provided on the case to keep in contact with the eccentric cam, and the displacement input part is coupled to the displaced shifter to make rotation of the reversing spring pushing part and the cam contact part around the release lever supporting part.

2. The thermal overload relay according to claim 1, wherein the adjusting link comprises, at one end, a bearing part rotatably supported on a support shaft provided on the case, and at a second end, a link support rotatably supporting only the release lever supporting part of the release lever.

3. The thermal overload relay according to claim 1, wherein the contact reversing mechanism is provided with a reversing mechanism support that has a coupling groove that supports the one end of the movable plate at the support point, and movable plate holding arms on which the other end side of the movable plate abuts and which support the movable plate in a tilted condition with a constant tilting quantity, the reversing spring is a tension coil spring having coupling parts with a configuration of a hook formed at both ends of the spring, one of the coupling parts coupling to the other end side of the movable plate and the other coupling part coupling to the spring support provided on the reversing mechanism support, and the reversing spring applies a tensile force to and holds the movable plate that abuts on and is supported by the movable plate holding arms in a tilted condition.

4. The thermal overload relay according to claim 3, wherein the movable plate and the tension coil spring are assembled to the reversing mechanism support in a joined single unit.

5. The thermal overload relay according to claim 3, wherein the reversing mechanism support is provided with an integral movable side terminal of a normally opened contact or an integral normally closed contact.

6. The thermal overload relay according to claim 1, wherein the displacement input part is a temperature compensation bimetal fixed to the release lever.

* * * * *

UNITED STATES PATENT AND TRADEMARK OFFICE

CERTIFICATE OF CORRECTION

PATENT NO. : 8,174,350 B2
APPLICATION NO. : 12/659283
DATED : May 8, 2012
INVENTOR(S) : Furuhata et al.

It is certified that error appears in the above-identified patent and that said Letters Patent is hereby corrected as shown below:

Change column 7, line 54, “the reset button 43ais pushed-in.” to --the reset button 43a is pushed-in.--.

Change column 7, line 62, “139b.” to --39b.--.

Change column 8, line 48, “thermal overload relay” to --thermal overload relay.--.

Signed and Sealed this
Eighteenth Day of September, 2012

David J. Kappos

David J. Kappos
*Director of the United States Patent and Trademark Office*